United States Patent [19]

Helft et al.

[11] 4,422,068

[45] Dec. 20, 1983

[54] INTRUSION ALARM SYSTEM FOR PREVENTING ACTUAL CONFRONTATION WITH AN INTRUDER

[76] Inventors: John M. Helft, Center Rd., Eagle Bridge, N.Y. 12057; Walter O. Noyes, 308 Elm St., Bennington, Vt. 05201

[21] Appl. No.: 275,734

[22] Filed: Jun. 18, 1981

[51] Int. Cl.[3] ..... G08B 29/00

[52] U.S. Cl. ..... 340/514; 340/506; 340/525; 340/529; 340/541

[58] Field of Search ..... 340/514, 515, 516, 506, 340/513, 502, 525–528, 531, 539, 540, 532, 541, 542, 543, 545, 547, 529; 179/5 R, 5 P; 340/825.06, 825.31

[56] References Cited

U.S. PATENT DOCUMENTS

| | | | |
|---|---|---|---|
| 2,852,766 | 9/1958 | Green | 340/545 |
| 3,011,163 | 11/1961 | Britt | 340/545 |
| 3,161,742 | 12/1964 | Bagno | 200/87 |
| 3,537,094 | 10/1970 | Hawkins et al. | 200/61.64 |
| 3,833,895 | 9/1974 | Fecteau | 340/539 |
| 3,971,009 | 7/1976 | Fujiwara | 200/61.66 |
| 3,978,478 | 8/1976 | Schmitz | 340/506 |
| 3,984,825 | 10/1976 | Fujita | 331/113 R |
| 4,047,165 | 9/1977 | Andreasson et al. | 340/331 |
| 4,212,003 | 7/1980 | Mishoe et al. | 340/574 |
| 4,247,847 | 1/1981 | Gontowski, Jr. | 340/566 |

OTHER PUBLICATIONS

"Stop Burglars Before They Enter Your Home", The Shelburne Co. , The New York Times, 3-1-81.

*Primary Examiner*—Donnie L. Crosland
*Attorney, Agent, or Firm*—Parmelee, Bollinger & Bramblett

[57] ABSTRACT

An intrusion detection system is specifically designed to avoid actual confrontation within a protected premises between a returning occupant and an intruder. The system forewarns a returning owner or occupant, before entering the premises, that an intrusion has occurred by providing a signal visible from the outside of the premises. In this manner, the owner is alerted to the possibility that an intruder may still be present within the premises, and confrontation is avoided. The system includes a test mode operable from outside the protected premises to determine if the system has been tampered with by an intruder. If no intrusion signal is observed by the returning owner, he must still test the system to ascertain if the absence of the intrusion signal is a result of no intrusion, or if it is the result of an intruder having tampered with the system, by for example, removing its power supply. An "all clear" signal observable from the outside of the premises indicates that the system is in working order and has not been tampered with or otherwise dismantled during the owner's absence.

20 Claims, 8 Drawing Figures

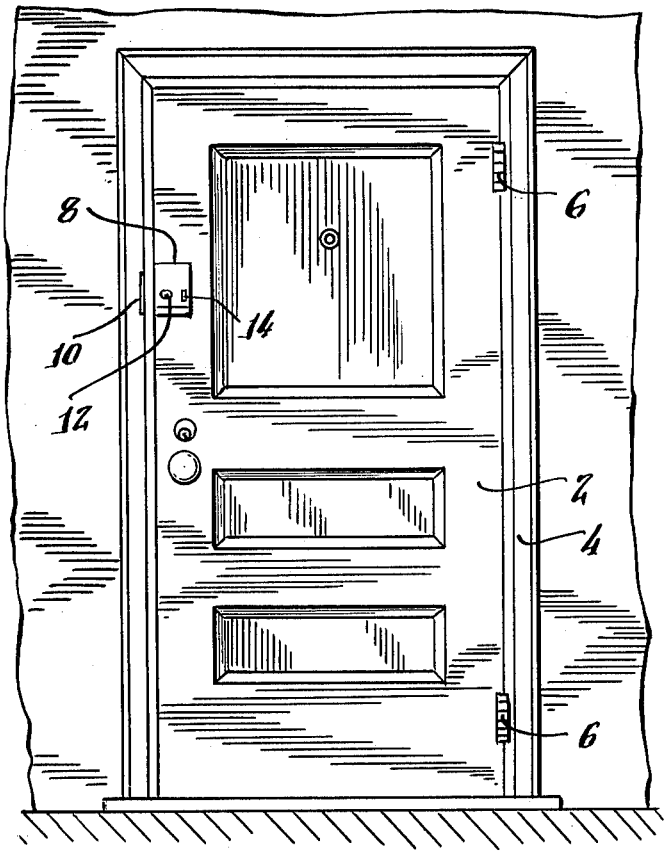
Fig. 1A
Fig. 1B.
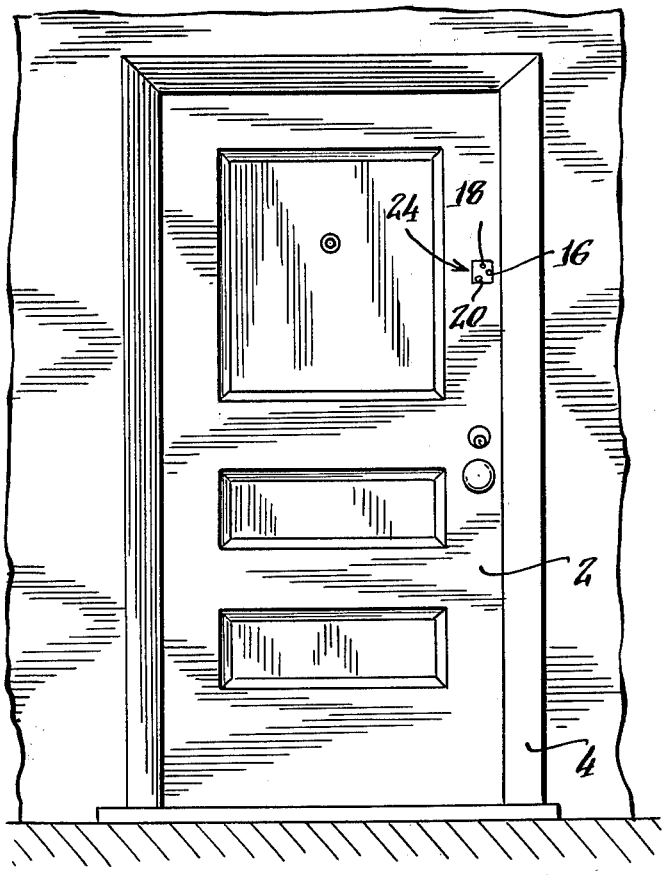
Fig. 5.
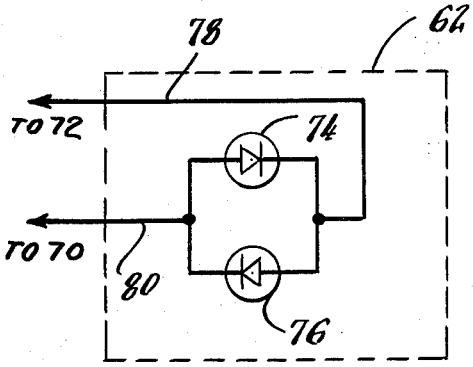

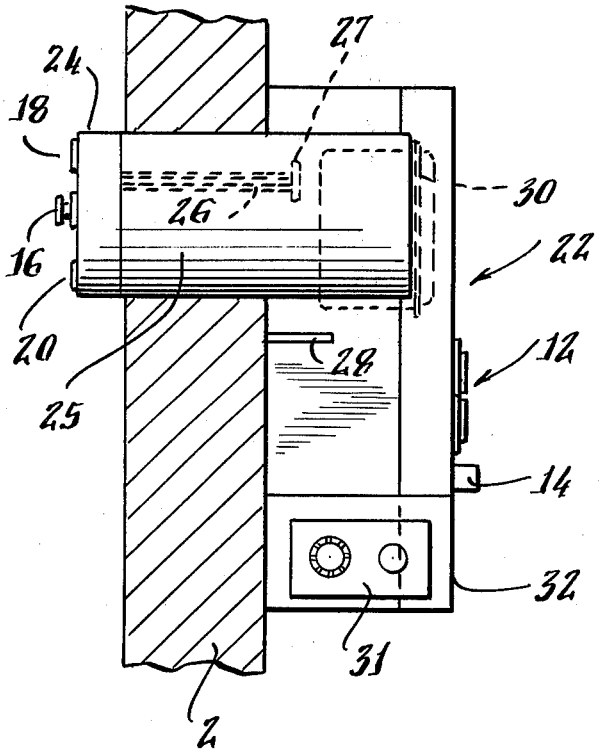
Fig. 2A.
Fig. 2B.
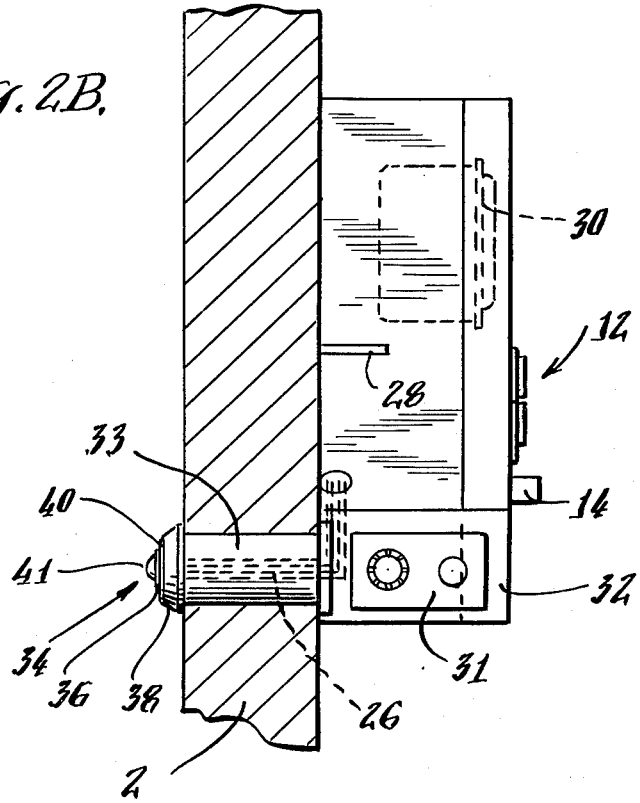

INTRUSION ALARM SYSTEM FOR PREVENTING ACTUAL CONFRONTATION WITH AN INTRUDER

BACKGROUND OF THE INVENTION

The present invention relates to alarm systems and more particularly to intrusion detection systems.

The primary purpose of known burglar alarm or intrusion detection systems is to either deter entry of an intruder or to aid in the apprehension of an intruder by alerting the authorities. The former type systems sound a loud audio alarm upon detection of an intruder to scare the intruder away and to alert anyone in the immediate vicinity of the premises of the intrusion. The latter type systems have "silent" alarms which provide remote signals to the police or other security agent to alert them that an intrusion is in progress so that the intruder may be apprehended. Some systems include features from each of the above type of systems. The known burglar alarm systems vary in cost and complexity from simple and inexpensive systems to highly sophisticated and costly systems.

The disadvantage inherent in the above-described systems is that they do not provide an indication to an owner of the secured premises, upon his return to the premises, that a break-in has occurred during his absence. For example, the "silent" alarms provide a signal only at a location remote from the secured premises. The audible type alarms may be timed to sound for only a predetermined period to avoid annoyance to neighbors. In any event, it is possible that an owner returning to the secured premises will not be alerted to the fact that a break-in has occurred or is in progress, and an actual confrontation with the intruder may result.

Certain known burglar alarm systems do provide a visual intrusion signal at a central alarm control box. However, the control boxes are located within the protected premises and cannot alert a returning owner to an intrusion before he enters the premises. Thus, an actual confrontation with an intruder within the premises is still possible.

The present invention overcomes the disadvantages of the above-described systems by providing an intrusion detection system specifically designed to generate an intrusion signal which is visible from outside of the protected premises to prevent an actual confrontation between a returning owner and an intruder within the premises. The present system also includes a test system, operable from outside the protected premises, to determine if the system has been tampered with, as for example by an intruder, during the owner's absence.

SUMMARY OF THE INVENTION

The present invention provides an intrusion detection system adapted to provide an intrusion signal visible from outside of a protected premises to avoid actual confrontation between a person returning to the premises and an intruder therein. The system includes an alarm unit at the border of the protected area, as for example, the inside of the front door of a protected house. A switch actuator is mounted to the door frame and substantially aligned with the alarm unit when the front door is closed. The alarm unit includes a lamp or light mounted to the front of the front door so as to be visible from outside the protected area. Control means within the alarm actuate the lamp upon detection of an intrusion, and the owner of the premises is alerted to an intrusion by the lamp, from outside the premises, upon his return.

The alarm unit further includes a test system which may be operated from outside the protected premises. The test mode enables the owner to determine if the alarm has been tampered with during his absence, and accordingly, if the absence of an intrusion signal is a result of such tampering and not a true indication that no intrusion has occurred. Failure of the test system to provide an "all clear" signal indicates that the alarm has been tampered with and an intruder may still be within the premises.

The alarm system provided by the present invention also may include conventional audible or silent alarm features which are operable at the selection of the user.

BRIEF DESCRIPTION OF THE DRAWINGS

FIG. 1A illustrates an alarm in accordance with the present invention mounted to a door, as viewed from within the premises protected by the alarm;

FIG. 1B illustrates the alarm of FIG. 1A mounted to the door, as viewed from outside of the protected premises;

FIG. 2A illustrates an elevational view, in section, showing an alarm unit in accordance with the present invention;

FIG. 2B illustrates an elevational view, in section, showing a slightly modified embodiment of the alarm unit illustrated by FIG. 2A;

FIG. 5 illustrates a pair of interconnected light emitting diodes that may be used to provide visual alarm and test signals in accordance with the alarm system of the present invention.

DISCUSSION OF THE PREFERRED EMBODIMENTS

Figure 3:
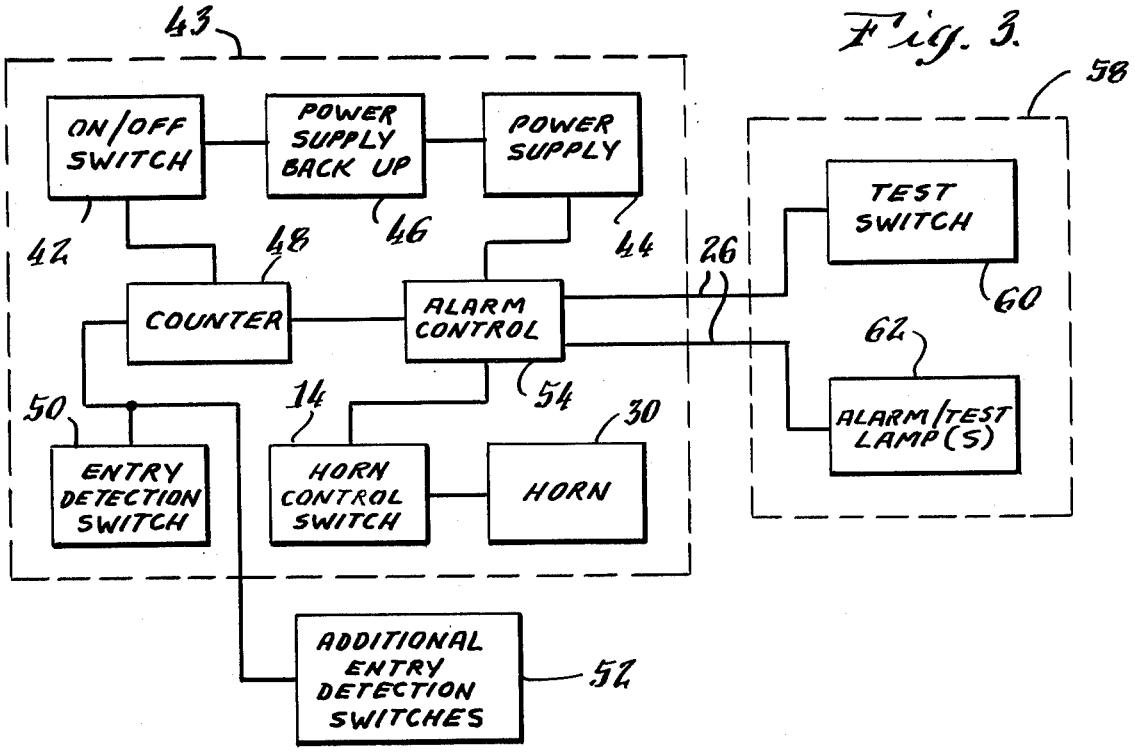
FIG. 3 is a block diagram illustrating the circuitry of an alarm in accordance with the present invention.

FIGS. 1A and 1B of the drawings illustrate an intrusion alarm in accordance with the present invention mounted to the front door of a premises to be protected. Specifically, FIG. 1A illustrates a front door 2 as it is seen from inside the protected premises while FIG. 1B illustrates that same door as seen from the outside of the premises. The door 2 is mounted to a door frame 4 by hinges 6. An alarm or intrusion detector, shown generally by reference numeral 8, is mounted near the side edge on the inside of the door and is movable therewith. A magnetic actuator 10, which may be a bar magnet, is mounted to the door frame 4 in substantial alignment with the intrusion detector when the door is closed. The intrusion detector has a keyhole 12 and a horn control switch 14, both of which face into the protected premises, and an alarm/test module 24 including a pushbutton switch 16 and two lamps 18 and 20 facing out from the front of the door and thus being visible from outside of the protected premises.

FIGS. 2A and 2B illustrate two similar embodiments of the intrusion detector 8 in accordance with the present invention. In FIG. 2A, the detector includes a housing 22 mounted to the inside of the door 2, and the module 24, including the lamps 18 and 20 and the pushbutton switch 16, mounted to the outside of the door 2.

A four-conductor cable 26, which runs along the side edge of the door 2, electrically connects the module 24 with the circuitry in the housing 22. A plate 25 is provided to protect the exposed portion of the cable running around the edge of the door. The cable 26 enters the housing through a slot or opening 27 in the housing. The keyhole 12 and the horn control switch 14 extend from the housing 22 into the protected premises. An alignment marking 28 on the outside of the housing is used to indicate the approximate position at which the magnetic actuator 10 should be mounted to the door frame 4 (FIGS. 1A and 1B) for proper alignment with the intrusion detector 8. A horn 30 and a power supply, for example a battery 31 within a battery compartment 32, are provided within the housing 22. The housing also contains alarm control means and suitable alarm control electronic circuitry (not shown in FIGS. 2A and 2B) which will be discussed in detail below.

The embodiment illustrated in FIG. 2B is similar to that of FIG. 2A, and accordingly, the same components are designated by the same reference numerals. The basic differences between these two embodiments is, firstly, that the electrical cable 26 of FIG. 2B runs through an opening 33 provided in the door 2, and not around the side edge of the door. Secondly, the push-button 16 on module 24 has been replaced by a touch sensitive switch 34 having two conductive rings 36 and 38 separated by an insulating layer 40 so that a finger or hand touching both conductive rings completes an electrical circuit. Also, the double lamps 18 and 20 of the FIG. 2A embodiment have been replaced by a single tri-state light emitting diode 41 mounted on the touch sensitive switch 34.

FIG. 3 illustrates, in block diagram format, electronic circuitry for implementing the alarm of the present invention. The broken-lined area 43 represents circuitry within the alarm housing 22 affixed to the inside of front door 2 (FIGS. 2A and 2B). An on/off switch 42 is operated by a key inserted into keyhole 12 (FIGS. 2A and 2B) at the rear of the housing 22 (within the protected premises) by an occupant prior to leaving the premises. The switch 42 is disposed between a power supply 44 (and a power supply back-up 46) and an electronic counter 48. When the switch is on, an electrical connection is made between the power supply 44 and the counter 48, while when the switch is off, there is no such connection to the counter 48 which remains off and set at "0". The power supply 44 may be a standard 9-volt transistor battery 31 stored within the battery compartment 32 (FIGS. 2A and 2B).

An entry detection switch 50 is electrically coupled to the counter 48. Additional detection switches 52 may be provided to protect or monitor different areas of the protected premises. Each of the entry detection switches 50 and 52 is a magnetically actuated switch, as for example, a reed switch. The entry detection switch 50 is located within the housing 22 mounted to the front door 2 (FIGS. 1A and 1B). The switch 50 is arranged so that when the front door 2 is closed and the switch is aligned with the magnetic switch actuator 10 mounted to the door frame 4, no signal is applied from the switch 50 to the counter 48. However, when the door is opened and the switch 50 is separated from the magnetic switch actuator 10, the switch provides a signal to the counter 48. The output of the counter 48 is coupled to an alarm control 54, which will be discussed below.

The horn control switch 14, also shown in FIGS. 2A and 2B, is disposed between the alarm control 54 and the horn 30 within the housing 22. Power is supplied to the alarm control 54 from the main power supply unit 44.

The above switching system is arranged to provide signals only when the door is opened, not when the door is closed, because an intruder must open the door to enter the premises but does not necessarily have to close the door. The specific circuitry providing this feature will be discussed with respect to FIG. 4A.

The broken-lined area 58 of FIG. 3 represents the module 24 (FIGS. 2A and 2B) that is affixed to the outside of front door 2 (FIG. 1B). The electrical cable 26 (shown also in FIGS. 2A and 2B) connects the circuitry in the housing 22 to the circuitry in the outside module 24. A test switch 60, corresponding to either pushbutton switch 16 of FIG. 2A or to touch sensitive switch 34 of FIG. 2B, is located within the module 24 and electrically coupled to the alarm control 54 within the housing 22 by two of the conductors in the four conductor cable 26. Alarm/test lamps 62, corresponding to either lamps 18 and 20 of FIG. 2A or to the tri-state light emitting diode 41 of FIG. 2B, are also located within the module 24 and electrically coupled to the alarm control 54 within the housing 22 by cables 26.

In operation, before opening the front door 2 to leave the protected premises, the owner or occupant will turn on the on/off switch 42 to its "ON" position with a key, thereby connecting the power supply 44 with the counter 48. Opening the front door 2 separates the entry detection switch 50 located within the housing 22 mounted on the door, from the magnetic switch actuator 10 mounted on the door frame, resulting in a first signal transmitted from that switch to the counter. The first signal registers a "1" with the counter 48, which was initially set at "0". Closing the door 2 by the occupant upon leaving the premises does not generate any further signals as discussed above, and the counter 48 remains set at "1".

For illustrative purposes, lamp 18 will be designated as the test lamp while lamp 20 is the alarm lamp. Accordingly, with the counter 48 set at "1" or "0", actuation of the test switch 60 causes test lamp 18 to light. However, both the horn 56 and the alarm lamp 20 are maintained de-energized by the alarm control when the counter is set at "0" or "1". Note that the test circuit is operative even with the counter 48 set at "0" (i.e., the on/off switch 42 turned off) because the power supply 44 is directly coupled to the alarm control 54 independent of the position of the on/off switch 42.

If the front door 2 is now opened again, as for example by an intruder after the occupant has left the premises and the alarm has been set, the entry detection switch 50 is again separated from the switch actuator 10 on the door frame. A second signal is now transmitted from the switch 50 to the counter 48, causing the counter to now register a "2" and output a signal. In response to this signal from the counter, the alarm control 54 actuates the alarm lamp 20 by completing a circuit between the power supply and the alarm lamp after a short delay. Simultaneously, the alarm control completes a circuit to the horn control switch 14. If the occupant of the premises has turned this switch 14 on before leaving (FIG. 2A), the horn 30 will sound. If switch 14 was not turned on, the horn will not sound but only lamp 20 will light in response to the second signal. As will be discussed below, even if the horn control switch is on, the horn will only sound for a predetermined time period. The alarm lamp 20, however, will remain lighted indefinitely.

Both the test lamp 18 and the alarm lamp 20 are mounted to the outside of the front door 2 (FIGS. 1B and 2A) and thereby can be observed from outside the protected premises. The alarm and test lamps 20 and 18 preferably are different colors so as to readily distinguish between the two. If, when the owner or occupant returns to the premises, he observes a lighted alarm lamp 20 from outside the front door, he is warned not to enter the premises because an intrusion either has occurred or is in progress. However, even if no alarm signal is observed, it still may be unsafe to enter the premises because an intruder may have deactivated the intrusion alarm by, for example, removing its power supply 44. To determine if this has occurred, the returning occupant actuates test switch 60 on the outside of the front door 2. If the test lamp 18 lights up, the power source and circuitry of the alarm system is in working order and has not been tampered with by an intruder. Failure of the test lamp to light indicates that the alarm may have been tampered with and that the occupant should not re-enter the premises.

Each of the above-described operations (observing to see if the alarm lamp 20 is lit, testing the system if the alarm lamp is not lit) is performed from outside the premises. There is no need to enter the premises until the returning occupant has determined it is safe to do so. Accordingly, the present intrusion detection system avoids the possibility of confrontation between a returning occupant and an intruder within the premises.

Figure 4:
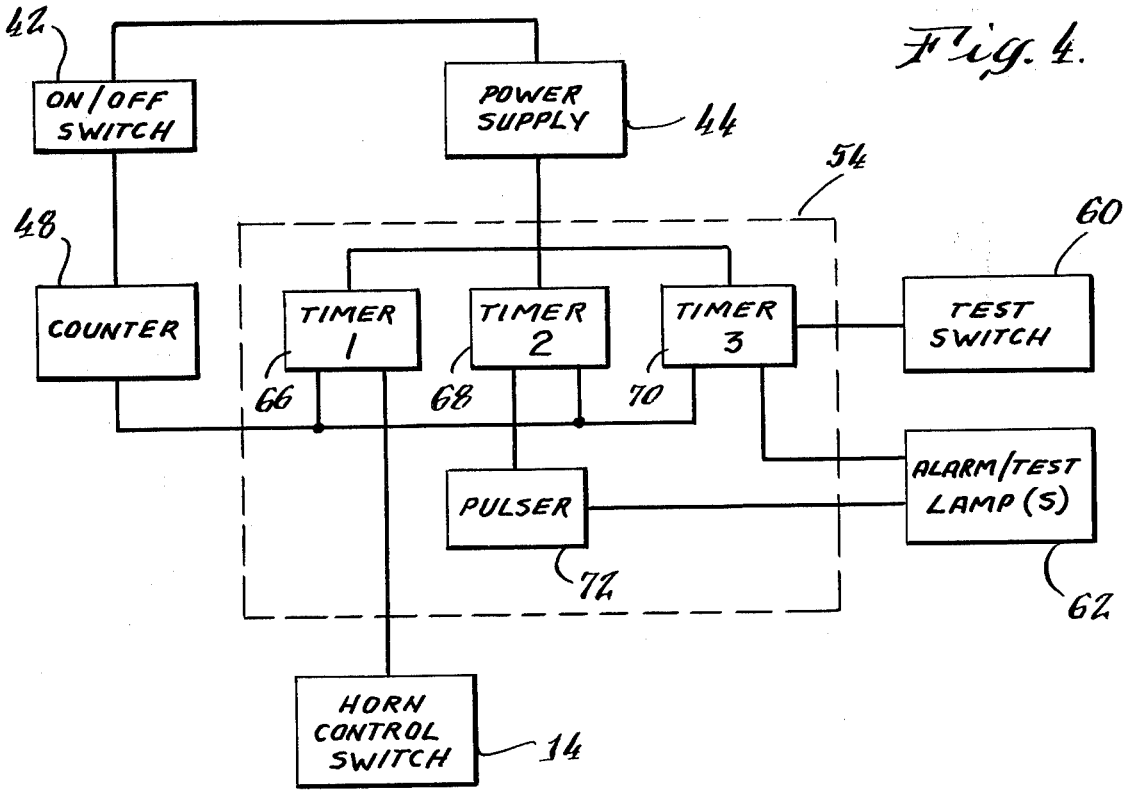
FIG. 4 is a block diagram showing in detail the components of the alarm control block illustrated in FIG. 3.

FIG. 4 of the drawings illustrates the alarm control 54 of FIG. 3 in greater detail. The alarm control 54 (shown in broken line) includes three timers 66, 68 and 70 coupled to the counter 48. The power supply 44 is also coupled to the three timers. The timer 66 is further coupled to the horn control switch 14, the timer 68 is further coupled to a pulser 72 which in turn is coupled to the alarm lamp 20 of the module 62, and the timer 70 is further coupled to the test lamp 18 of the module 62.

When the counter is set at "0" or "1" as discussed above, an electrical circuit is completed between the test switch 60 and the test lamp 18 through the timer 70. The test lamp is lighted upon actuation of the test switch, but the timer 70 causes it to go out after a predetermined time period. The timer 70 is automatically reset after deactuation of the test lamp.

When the counter 48 registers "2" as a result of an intrusion, as discussed above, the horn 30 is actuated through a completed circuit between the horn control switch 14 (assuming that this switch was turned on by the occupant before leaving the premises), the timer 66, and the power supply 44. The horn sounds for a predetermined time period which is controlled by the timer 66.

Simultaneously with the actuation of the horn control switch 14 upon detection of a "2" registered with the counter 48 and the resultant output signal from the counter, the pulser 72 is actuated through the timer 68 after a momentary delay determined by the timer 68. The pulser 72 then actuates the alarm lamp 20 which continues to flash. When the alarm light is on, the alarm circuit overrides the circuit between the test switch and the test lamp. Accordingly, the test lamp 18 cannot be lighted when the alarm lamp 20 is on.

As illustrated above, the counter 48, which itself is controlled by the entry detection switches 50, 52, controls the test and alarm modes of the present system. To deactuate the alarm light, the returning occupant uses his key to turn off the on/off switch 42 to thereby disconnect the power supply 44 from the counter 48. The counter is automatically reset to "0" by this power loss, as are the timers 66 and 68. The system is now in an inactive mode, and can only be reactivated by turning on the on/off switch 42 and opening the front door 2, as was described above. When the alarm system is inactive, the counter 48 remains at "0" and only the test mode circuit is enabled, as previously discussed.

Although the above description of FIGS. 3 and 4 is directed to the embodiment of the alarm having separate test and alarm lamps 18 and 20, as illustrated by FIG. 2A, it is possible to use only a single lamp such as a tri-state light emitting diode 41, as was discussed with respect to FIG. 2B. In either case, operation of the alarm is the same as discussed above.

Figure 4A:
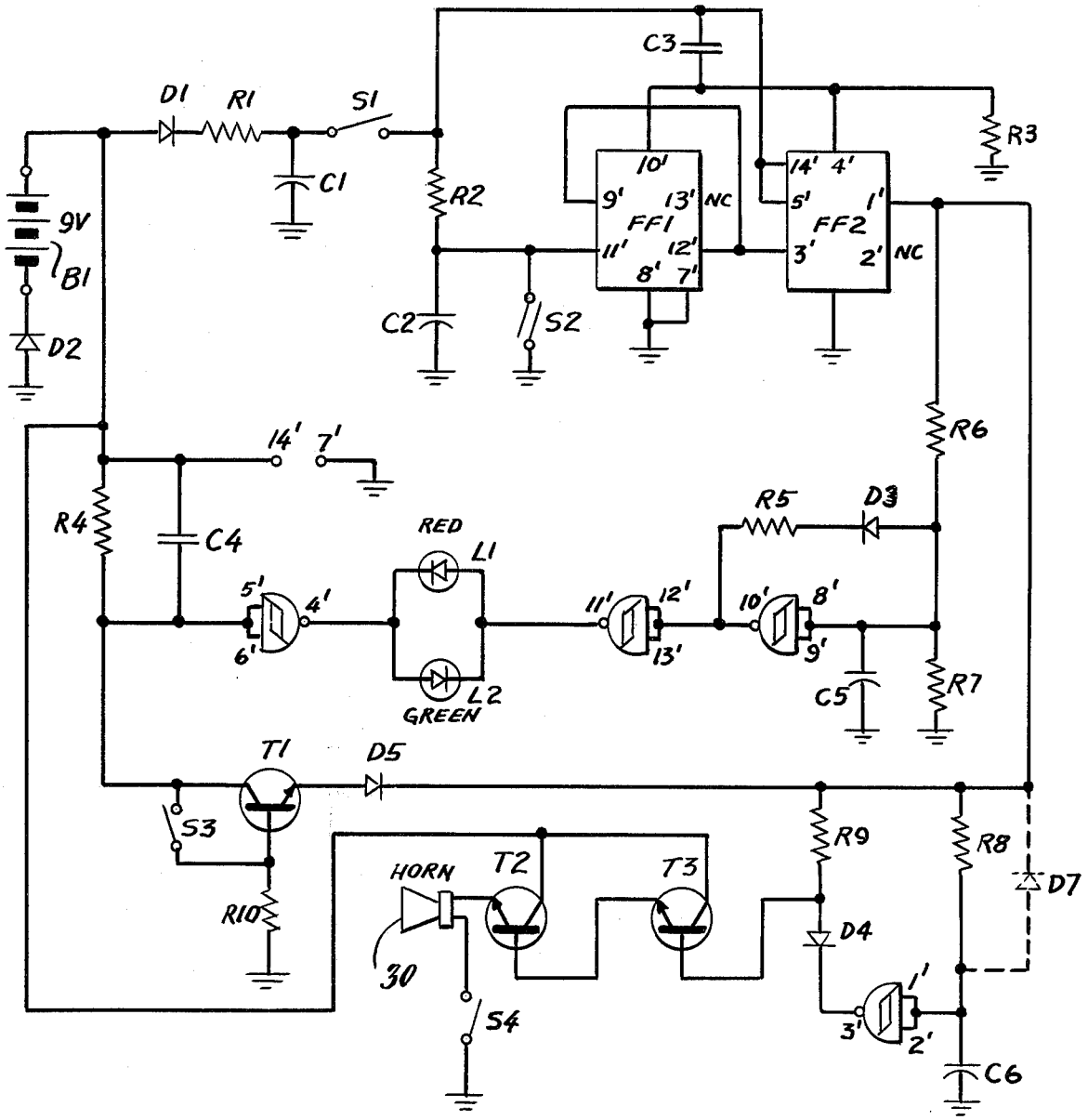
FIG. 4A illustrates an example of specific electronic circuitry that may be used in the present system.

FIG. 4A illustrates an example of one embodiment of the specific circuitry of the intrusion detection system of the present invention. The following discussion of this figure is divided into four separate sections to individually discuss the counter, the horn control, the alarm light pulser, and the test circuit.

COUNTER

The counter 48 is a dual type D flip/flop. When S1 (corresponding to on/off switch 42 of FIG. 3) is closed, the output 12' of the first flip/flop FF1 is high, setting the data 9' high. The output 1' of the second flip/flop FF2, which is also the output of the counter, is low. The data 5' of the second flip/flop is high. Because the front door 2 (FIGS. 1A and 1B) is closed, switch S2 (corresponding to entry detection switch 50 of FIG. 3) is closed, and the clock 11' of the first flip/flop is held low.

When the door is open, S2 opens and a positive pulse is transmitted to clock 11'. Resistor R2 and capacitor C2 are provided to prevent switch bounce of S2 from applying several pulses onto the clock and thereby inadvertently setting the counter at "2". The positive pulse on clock 11' causes the output 12' to go low. When the front door 2 is closed, a negative pulse is applied to the clock 11', but no change in the outputs takes place.

The next time the door 2 is opened, switch S2 opens and another positive pulse is applied to the clock 11'. This causes output 12' to transmit a positive pulse to clock 3' and output 1' goes high. The output 1' remains high until the device is turned off with the switch S1.

HORN CONTROL

In the normal state, the output 1' from the counter is low so that capacitor C6 and gates 1' and 2' are low and the output 3' is high. The blocking diode D4 prevents current from being conducted to the base of transistor T3 from output 3' of gates 1' and 2'. Transistors T3 and T2 are connected in a Darlington configuration, and because the counter output 1' is low, and because blocking diode D4 prevents current from gate output 3' from flowing, transistors T3 and T2 are turned off.

When counter output 1' goes high, current flows through a limiting resistor R9 to the base of transistor T3 which now conducts and turns on transistor T2 which amplifies the current, Both transistors' collectors are connected directly to a battery B1 corresponding to power supply 44 of FIG. 3. The emitter of transistor T2 is connected to the positive terminal of the horn 30 of FIG. 3. If switch S4 is closed the circuit is completed and the horn sounds. If S4 is open, the horn does not sound.

When counter output 1' goes high, it begins to charge capacitor C6 through resistor R8 to provide timer 66 of FIG. 4. When capacitor C6 (and gates 1' and 2') reach the upper threshold voltage, output 3' goes low and sinks the current from resistor R9 away from the base of transistor T3. This turns off the horn.

Timer 66 is reset when the counter output 1' goes low and the capacitor C6 discharges through the resistor R8. An optional diode D7 (shown in broken line) may be used to speed the discharge of the capacitor C6.

ALARM LIGHT PULSER

When the counter outputs a signal at 1', resistors R6 and R7 form a voltage divider and, in combination with a capacitor C5, form a delay timer (corresponding to timer 68 of FIG. 4). Gates 8' and 9' are initially low so gate output 10' is high, and gates 12' and 13' are high so gate output 11' is low.

When the voltage builds on capacitor C5 to the upper threshold voltage, output 10' goes low, gates 12' and 13' are low, and output 11' is high. Light emitting diode L1 (corresponding to the alarm lamp 20 of FIG. 2A) conducts causing the alarm lamp to glow.

When output 10' goes low, capacitor C5 discharges through a diode D3 and a resistor R5. After a short time, the voltage on capacitor C5, and therefore gates 8' and 9', drop below the lower threshold voltage, the output 10' goes high, causing gates 12' and 13' to be high and output 11' to go low. Light emitting diode L1 no longer conducts, and the alarm lamp goes out.

Capacitor C5 begins to build up voltage again and when it reaches the upper threshold voltage, output 10' goes low and the process repeats. This causes LED L1 to flash until the counter output is inactivated by turning the main on/off switch S1 off.

TEST CIRCUIT

Normally, in the absence of an intrusion signal, the output 1' from the counter is low. The input to gates 5' and 6' is high because a transistor T1 is not conducting. When the terminals on a switch S3 (which corresponds to the test switch 60 of FIGS. 4 and 4A) are connected, as for example, by touching them with a finger, an electrical circuit is completed between the collector and base of transistor T1. This allows transistor T1 to conduct through a diode D5 to output 1' of the counter which is low and causes gates 5' and 6' to go low.

Gate output 4' now goes high and an LED L2 (corresponding to the test lamp 18 of FIG. 2A) conducts to the output 11' of the next gate 12' and 13'. This gate is low since output 1' of the counter is low. Gates 8' and 9' are low and output 10' is high. A diode D3 prevents feedback to gates 8' and 9'. Now gates 12' and 13' are high and therefore output 11' is low and can sink the signal from the LED L2.

Resistor R4 and capacitor C4 form a timing network (corresponding to timer 70 in FIG. 4) such that when the finger is removed from the terminals of S3, and transistor T1 stops conducting, the voltage on gates 5' and 6' slowly rises, as capacitor C4 charges, until it reaches the upper threshold voltage and the output 4' goes low causing LED L2 to turn off. This gives a momentary delay allowing the user to see that the test lamp 18 of FIG. 2A (corresponding to LED L2) is on, but does not waste power in keeping LED L2 on indefinitely.

If the output 1' of the counter is high, transistor T1 cannot conduct and therefore gates 5' and 6' cannot go low. Thus, the test circuit is inactivated when the counter output 1' is high, as when the alarm circuit is actuated.

FIG. 5 illustrates the arrangement of two light emitting diodes 74 and 76 used as the test and alarm lamps, respectively, in the FIG. 2A embodiment of the present intrusion detection system. Module 62 (FIGS. 4 and 4A) is shown in broken line. Electrical lead 78 connects the anode of the alarm light emitting diode 76 and the cathode of the test light emitting diode 74 to the pulser 72 (of FIG. 4). Electrical lead 80 connects the anode of the test light emitting diode 74 and the cathode of the alarm light emitting diode 76 to the timer 70 (of FIG. 4).

When there is no positive signal from either the timer 70 or the pulser 72, leads 78 and 80 are both near ground potential. However, a positive signal from the timer 70 (indicating actuation of the test switch 60) is conducted through lead 80, putting a forward bias on test light emitting diode 74, and causing test LED 74 to conduct, while alarm LED 76 does not conduct. The test lamp lights up. Likewise, when a pulsed signal is transmitted by the pulser 72, the pulsed signal is conducted through lead 78, putting a forward bias on alarm light emitting diode 76, and causing alarm LED 76 to conduct while test LED 74 does not conduct. The alarm lamp lights up, flashing on and off as a result of the pulsed signal. This positive pulsed signal is conducted back through lead 80 to the timer 70 which remains at ground potential. As noted above, the alarm control unit (of FIG. 3) disables the test circuit whenever the alarm is actuated. Also as noted above, the alarm and test lamps are preferably of different colors (e.g., red and green) to enable an occupant returning to the protected premises to readily distinguish between the test and alarm modes.

The embodiments of the invention discussed above provide an intrusion detection system primarily directed to avoiding a potentially dangerous confrontation between a returning occupant and an intruder within the premises. The system provides a visual signal to the returning occupant that an intrusion has occurred during his absence or an intrusion is then in progress. The signal is visible from outside the premises so that the returning occupant need not even enter the premises if a dangerous condition exists. Furthermore, the intrusion detection system includes a test feature in which a returning occupant who does not see an intrusion signal may still test the alarm, without entering the premises, to determine if it was tampered with during his absence.

The embodiments of the invention discussed above are intended to be illustrative only. For example, although the intrusion detection system was shown as being mounted to doors, it is also possible to monitor windows and other entrances to the protected premises by the present system. Also, although the test mode illustrated above provides a visual test signal, it is within the scope of the invention to provide other type test signals discernable from outside the protected premises, as for example, an audible test signal. Further, although in the preferred embodiment the intrusion detection switches are magnetically actuated, other types of mechanical, optical or electrical switches may be used in the present system. Accordingly, the above-described embodiments are intended to be illustrative but not restrictive of the scope of the invention, that scope being defined by the following claims and all equivalents thereto.

What is claimed is:

1. An intrusion detection system adapted to provide an intrusion detection signal observable from outside of a protected premises to warn a returning occupant of a possible intrusion and thereby avoid a potential confrontation between the returning occupant and an intruder within the protected premises, said detection system comprising:

an alarm lamp mountable on an entrance to the protected premises and observable from without said protected premises, means for actuating said alarm lamp in response to an intrusion through the entrance of said protected premises, and a test circuit coupled to said means for actuating said alarm lamp for providing a test signal, said test circuit being mountable on said entrance to the protected premises such that it is operable from without the protected premises for determining if said means for actuating said alarm lamp is operational, said test circuit being positionable such that said test signal is discernable from without the protected premises, whereby said alarm lamp is observable from without said protected premises and said test circuit is operable from without the protected premises.

2. The system of claim 1 wherein said test circuit includes:

a test switch mountable on the entrance of the protected premises and operable from without the protected premises, and a test lamp coupled to said test switch, said test lamp being mountable on said entrance in a position in which it is observable from without the protected premises.

3. The system as claimed in claim 2 wherein said test and alarm lamps are provided by two separated light emitting diodes.

4. The system as claimed in claim 2 wherein said test and alarm lamps are provided by a single tri-state light emitting diode.

5. The system as claimed in claim 1 wherein said means for actuating said alarm lamp is mountable to the inside of a door or window of said protected premises, and said alarm lamp is mountable to the outside of said door or window.

6. The system as claimed in claim 5 further including a magnetic switch actuator mountable to the frame of said door or window such that said magnetic switch actuator is substantially alinged with said means for actuating said alarm lamp when said door or window is closed, said means for actuating said alarm lamp including a magnetically actuated switch, the state of said magnetically actuated switch being controllable by the relative positions of said door or window and said door or window frame.

7. The system of claim 6 wherein said means for actuating said alarm lamp further includes a power supply coupled to said magnetically actuated switch and so arranged to transmit an electrical signal through said magnetically actuated switch in response to the opening of said door or said window.

8. The system of claim 7 wherein said means for actuating said alarm lamp further includes a counter coupled to said magnetically actuated switch for registering said electrical signals transmitted through said magnetically actuated switch.

9. The system as claimed in claim 8 wherein said means for actuating said alarm lamp further includes control circuitry coupled to the output of said counter for selectively completing an electrical circuit between said power supply and said alarm lamp upon detection of a predetermined signal registered in said counter.

10. The system as claimed in claim 9 wherein said test circuit is connected to said power supply through said control circuitry, said control circuitry including means for disabling said connection between said test circuit and said power supply when an electrical circuit is completed between said power supply and said alarm lamp.

11. The system as claimed in claim 10 further including an audible horn, said horn coupled to said power supply through said control circuitry, said control circuitry including means for actuating said horn with the actuation of said alarm lamp.

12. The system of claim 11 further including a horn control switch coupled to said horn for selectively disabling said horn independent of said control circuitry.

13. The system of claim 11 wherein said control circuitry includes a timer electrically coupled to said audible horn for controlling the time which said horn sounds.

14. The system as claimed in claim 1 wherein said test circuit includes a timer for controlling the time period for which said test signal is generated after said test circuit is actuated.

15. The system of claim 2 wherein said means for actuating said alarm lamp further includes control circuity for selectively completing an electrical circuit between a power source and said alarm lamp in response to a predetermined intrusion signal.

16. The system of claim 15 wherein said test circuit is coupled to said power source through said control circuitry for actuating said test lamp to provide said test signal in response to actuation of said test switch, wherein removal of said power source or said control circuitry from said system will prevent said test lamp from lighting in response to the actuation of said test switch.

17. The system of claim 16 wherein said control circuitry includes means for disabling the circuit between the test lamp and the power supply when a circuit between the power supply and the alarm lamp is completed.

18. The system of claim 15 wherein said means for actuating said alarm lamp further includes a counter coupled to the input of a pulser through said control circuitry, said pulser being coupled to said alarm lamp for selectively providing electrical pulses to said alarm lamp in response to a predetermined alarm signal registered in said counter and transmitted through said control circuitry to said pulser.

19. An intrusion detector comprising:

an alarm lamp mountable to the outside of an entrance of a premises to be protected, a test lamp mountable to the outside of said entrance of the premises to be protected, a test switch coupled to said test lamp for selectively actuating said test lamp to provide a test signal, said test switch being mountable outside the premises to be protected, means for actuating said alarm lamp in response to a predetermined intrusion signal, and a power supply operatively coupled to said test switch and to said means for actuating said alarm lamp such that the generation of said test signal in response to the actuation of said test switch indicates that said intrusion detector is operable.

20. The intrusion detector of claim 19 further including control circuitry operatively coupled to said power supply for disabling the circuit between said power supply and said test lamp when said alarm lamp is actuated in response to said predetermined intrusion signal.

* * * * *